US005647754A

United States Patent [19]

Kohno

[11] Patent Number: 5,647,754

[45] Date of Patent: Jul. 15, 1997

[54] SHORT-CIRCUIT CONNECTOR

[75] Inventor: Toshiaki Kohno, Yokosuka, Japan

[73] Assignee: The Whitaker Corporation, Wilmington, Del.

[21] Appl. No.: 456,355

[22] Filed: Jun. 1, 1995

[30] Foreign Application Priority Data

Aug. 7, 1994 [JP] Japan ..... 6-157034

[51] Int. Cl.[6] ..... H01R 13/627

[52] U.S. Cl. ..... 439/188; 439/489; 439/595; 200/51.1

[58] Field of Search ..... 439/188, 489, 439/595; 200/51.1

[56] References Cited

U.S. PATENT DOCUMENTS 5,263,872 11/1993 Marpoe, Jr. et al. ..... 439/188
5,277,608 1/1994 Oda ..... 439/188
5,391,087 2/1995 Fukuda ..... 439/489 X
5,466,168 11/1995 Liebich et al. ..... 439/188
5,494,450 2/1996 Kirsch et al. ..... 439/188

*Primary Examiner*—Jes F. Pascua

[57] ABSTRACT

A short-circuit connector 2 having short-circuit contacts 20 arranged along electrical contacts 14 to be short-circuited, whereby the short-circuit contacts 20 have a base plate 20*a* secured in the housing 8 and a pair of contact arms 20*b* which are bent from the back edge of the base plate 20*a* toward the front end of the base plate 20*a*. Under each of the contact arms 20*b*, two primary restriction members 20*c* bent from the side edges of the base plate 20*a* are provided and a secondary restriction member 20*d* bent in a transverse direction from the center of the base plate 20*a* is also provided.

20 Claims, 6 Drawing Sheets

SHORT-CIRCUIT CONNECTOR

FIELD OF THE INVENTION

This invention relates to electrical connectors, especially to short-circuit connectors used for the operation of automotive air bags having short-circuit contacts short-circuiting electrical contacts contained in a housing and more specifically to the structure of the short-circuit contacts.

BACKGROUND OF THE INVENTION

Conventional short-circuit electrical connectors are known in the art, for example, the connector described in Japanese Patent Publication No. 93-290917. Such connectors are used in automotive air bags and similar equipment. They have short-circuit contacts used to short-circuit some of the electrical contacts of the same connector in order to avoid an accidental activation of air bags during inspection or assembly procedures.

In short-circuit electrical connectors of this type, the short-circuit contacts connect with electrical contacts and short-circuits several electrical contacts when the connector is disconnected from a mating connector. When the connector is joined again with the mating connector, a short-circuit releasing member within the mating connector operates the short-circuit contacts within their limit of elasticity so that they are separated from the electrical contacts, thus interrupting the short-circuited condition. The short-circuit contacts must have contact arms possessing sufficient resiliency for producing a reliable connection with the electrical contacts.

However, in conventional short-circuit connectors, there were cases when the contacting arms of the short-circuit contacts were inadvertently bent or deformed beyond their limit of elasticity by assembly tools inserted inside the connector housing during assembly, thus rendering them unsuitable for performing their functions.

The purpose of the invention is to offer a short-circuit connector in which the deformation of the short-circuit contact does not exceed the limit of its elasticity even when it is bent by assembly tools.

SUMMARY OF THE INVENTION

The short-circuit connector according to this invention has a short-circuit contact with a plate-shaped base which extends in the direction of the electrical contacts which are to be short-circuited. The short-circuit contact is retained in a housing and has a pair of contact arms for making the short-circuited connection. These short-circuit contact arms are bent at one end of the base and extend to the other end of the base. There are a pair of restriction members formed by bending the edges of the base plate under the two contact arms. Therefore, when the contact arms are bent downward by an assembly tool, they engage against these restriction members which prevent the arms from being deformed in excess of their limit of elasticity. In addition, since the pair of short-circuit contact arms are formed by bending from one edge of the base plate to the other, it is possible to increase the length of the portion of the contact arms subject to deformation when a load is applied, thereby reducing their fatigue in the event of repetitive use.

BRIEF DESCRIPTION OF THE DRAWINGS

An embodiment of the invention will now be described by way of example with reference to the accompanying drawings in which.

DETAILED DESCRIPTION OF THE INVENTION

Figure 1:
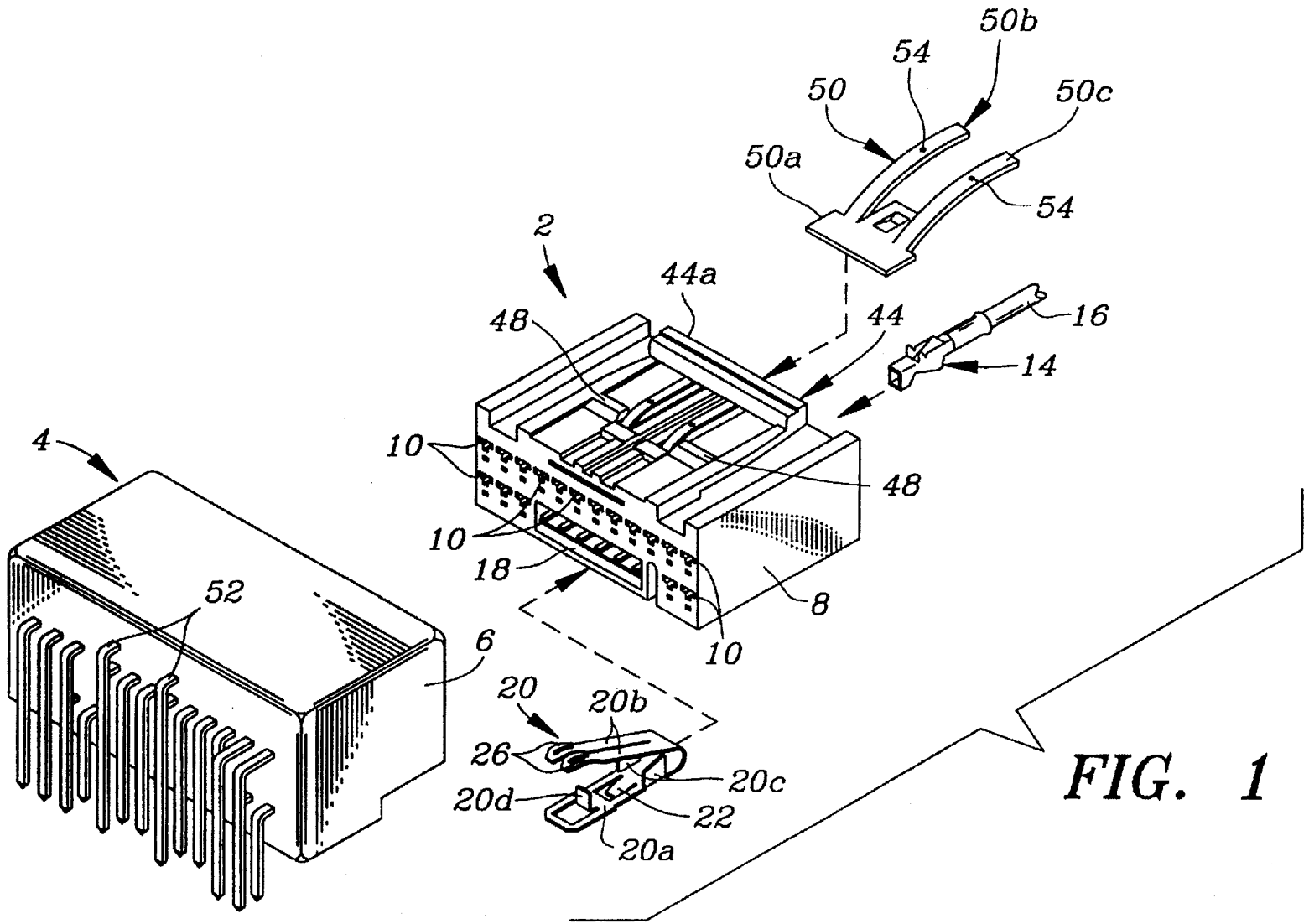
FIG. 1 is an exploded perspective view showing the various parts of an embodiment of a short-circuit electrical connector.
Figure 3:
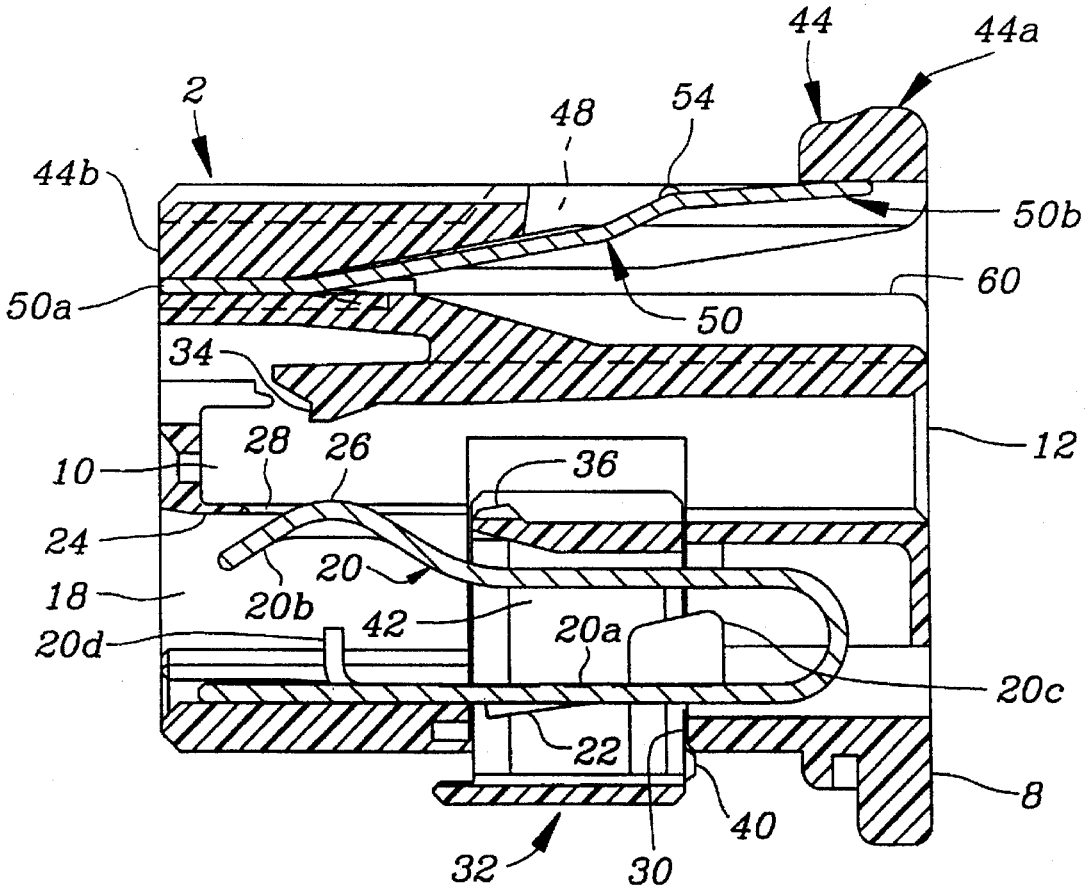
FIG. 3 is a cross-sectional view showing the interior of the male electrical connector in FIG. 1 without electrical contacts.

FIG. 1 shows an electrical connector 2 having a male dielectric housing 8 which is inserted into a female dielectric housing 6 of a mating connector 4. As shown in FIG. 3, dielectric housing 8 has a number of contact cavities 10 formed in the insertion direction of the electrical connector having contact receiving sections 12. The contact cavities 10 are arranged in the dielectric housing 8 in upper and lower rows. Female contacts 14 connected to signal wires 16 which are connected to an air bag controlling device are inserted in all contact cavities 10.

As can be seen from FIG. 1, under and close to the six central contact cavities 10 of the upper row, a cavity 18 is provided in the lower row for the short-circuit contacts. Three short-circuit contacts 20 are placed in the short-circuit contact cavity 18 so they short-circuit three groups of contacts 14 located in contact cavities 10.

Figure 2:
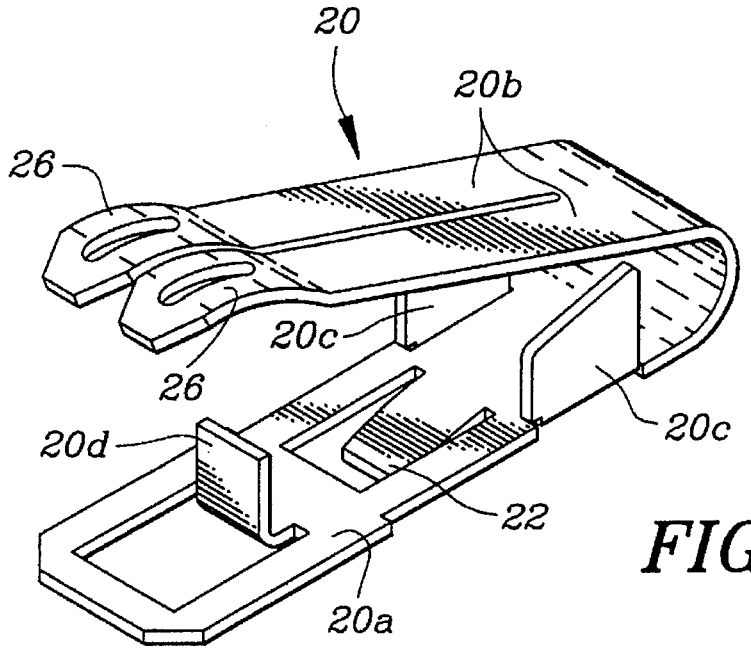
FIG. 2 is an enlarged perspective view of the short-circuit contact in FIG. 1.

All of these short-circuit contacts 20 are formed from a thin conductive metal sheet in the shape shown in FIG. 2. The short-circuit contacts 20 have a base plate **20*a* extending in the horizontal direction and a pair of short-circuiting contact arms 20*b* formed by bending the back end of the base plate 20*a* towards its front end. Under these contact arms 20*b*, a pair of primary restriction members 20*c* are formed by bending upwardly portions of the base edges from both sides of the base plate 20*a* near the point of origin of the contact arms 20*b*. A secondary restriction member 20*d* is provided under the contact arms 20*b* near their tips which is bent upward from the center of the base plate 20*a* towards the contact arms 20*b*** in a transverse direction.

The primary restriction members **20*c* extend lengthwise along contact arms 20*b*, and when the contact arms 20*b* are pushed down, their portions adjacent to the base plate 20*a* engage with the primary restriction members 20*c* and further bending of the contact arms 20*b* is prevented. The primary restriction members 20*c* are shaped so that their back ends are higher than their front ends in order to better restrict the bending of contact arms 20*b*. Due to the fact that the primary restriction members 20*c* are extended in the direction of the length of contact arms 20*b*, they will engage with contact arms 20 in a much wider range than if they were made in a transverse direction. This arrangement makes it possible to avoid the concentration of stress within an extremely narrow area when the contact arms 20***b* engage with the primary restriction members 20*c*. On the other hand, the function of the secondary restriction member 20*d* located under the contact arms 20*b* is to prevent the bending of the contact arms 20*b* beyond the point when the tips of the contact arms 20*b* engage with the secondary restriction member 20*d*.

FIG. 3 shows a latch member 22 provided in the base plate 20*a* which is slanted downward and forward. When the short-circuit contact 20 is inserted in cavity 18, the latch member 22 engages with a retainer for the short-circuit contact (not shown), thus securing the short-circuit contact 20 in the cavity 18. As can be clearly seen from FIG. 3, the free ends of contact arms 20*b* have arcuate arcuate-shaped contact section 26 facing upward and they extend into the contact cavities 10 through openings 28 in a partition 24 separating the contact cavities 10 and the short-circuit contact cavity 18.

Also, it can be seen from FIG. 3 that an opening 30 is located in the bottom wall of dielectric housing 8 through which a double lock device 32 is inserted into contact cavity 10 from the side of the short-circuit contact 20. This double lock device 32 has a stop member 36, which together with a resilient latch 34 formed in the upper wall of the contact cavity 10 forms a double lock for female contact 14 when the latter is inserted in contact cavity 10. This stop member 36 is formed as a continuous ridge on the surface of the double lock device 32 running in a transverse direction, which also contributes to the strength of the double lock device 32.

Figure 4:
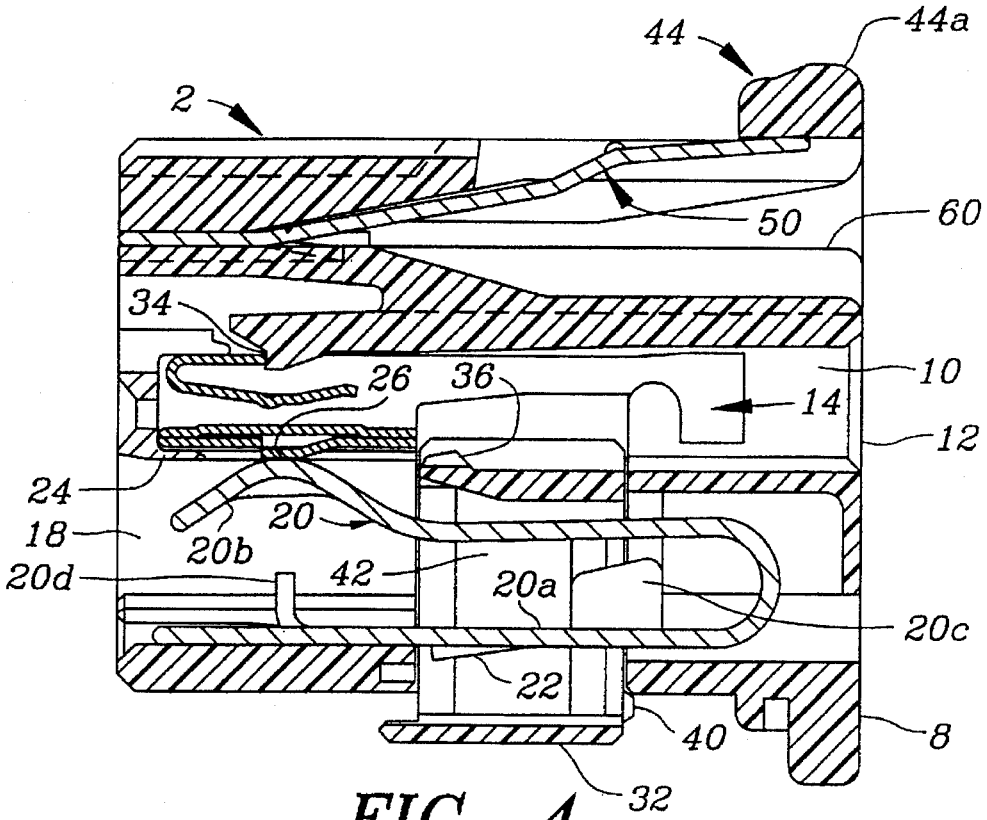
FIG. 4 is a cross-sectional view showing the electrical connector in FIG. 3 with contacts and a double lock device in a temporarily locked position.
Figure 5:
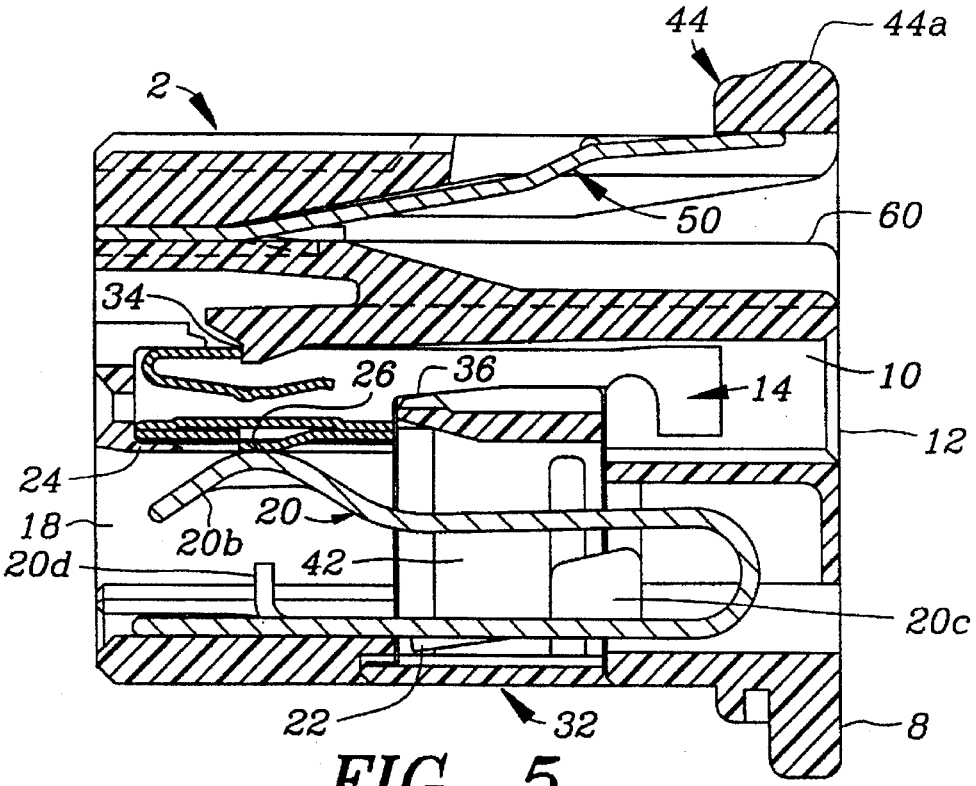
FIG. 5 is a cross-sectional view showing the interior of the electrical connector in FIG. 4 with the double lock device in the fully locked position.

On the back edge of the lower part of the double lock device 32, lugs 40 are provided for temporarily locking and for the final locking of the double lock device in the connector. The double lock device is inserted in dielectric housing 8 to a position (FIG. 3) in which the lugs 40 for temporarily locking become engaged with dielectric housing 8. In this temporarily locked position, as shown in FIG. 3, the stop member 36 does not extend into the contact cavity 10, and the female contacts 14 can be inserted in the contact cavities 10 (see FIG. 4). After the female contacts 14 are inserted in the contact cavities, the double lock device 32 is moved into dielectric housing 8 to the fully locked position, at which the locking lugs 40 become engaged with dielectric housing 8. In this position, the stop member 36 extends into the contact cavity 10 and locks the female contacts 14 in position therein (FIG. 5).

In addition, double lock device 32 has a hollow cavity 42 passing through its body whose purpose is to accommodate the placement of short-circuit contacts 20. During the assembly, the double lock device 32 is inserted in the opening 30 in dielectric housing 8 to the temporarily locked position as shown in FIG. 3, after which the short-circuit contacts 20 are inserted in cavity 18 and into hollow cavity 42. This hollow cavity 42 is configured in such a manner as to avoid interference of the double lock device 32 with the short-circuit contacts 20 when the device is moved from the temporarily locked position to the fully locked position. Once the short-circuit contacts 20 are inserted in the hollow cavity 42 and the double lock device 32 is placed in the temporarily locked position, there is no danger that the double lock device 32 will be lost during transportation or handling. Also, when the double lock device 32 is in the fully locked position, it provides for the displacement of the short-circuit contacts 20 when they are separated from the female contacts 14.

As can be seen from FIG. 1, a spring-loaded locking lever 44 is provided on the upper surface of dielectric housing 8 for the purposes of connection and disconnection with mating connector 4. From FIG. 3 one can see that this spring-loaded latching member 44 represents a spring-loaded cantilevered member extending from the side of dielectric housing 8 facing the mating connector 4. Latching member 44 has latching steps 48 which become engaged with lugs 46 (FIG. 6) located on the inside surface of dielectric housing 6 of the mating connector 4. The engagement of latching steps 48 and lugs 46 can be released by pressing downward the end 44*a* of the latching member 44.

As can be seen from FIG. 1, a connection indicator 50 is provided under this spring-loaded latching member 44. This connection indicator 50 includes a base 50*a* and two spring-loaded connection indicator arms 50*b* and 50*c*. As can be seen from FIG. 3, the base 50*a* is secured at fixed end 44*b* of the spring-loaded latching member 44 and the ends of the spring-loaded connection indicator arms 50*b* and 50*c* fit under end 44*a* of the spring-loaded latching member 44. This connection indicator 50 is shaped in such a configuration that it develops a force pushing the end 44*a* of the spring-loaded latching member 44 upward, thus enhancing the strength of the spring-loaded latching member 44 and preventing it from deforming under extreme conditions like high temperature, which can lead to the releasing of the connectors. In addition, dielectric housing 8 has protrusions 60 under the spring-loaded connection indicator arms 50*b*, 50*c* extending over the entire length of the housing. The purpose of these protrusions is to prevent the accidental deformation of the spring-loaded connection indicator arms 50*b*, 50*c*, for example, during the use of assembly tools where the spring-loaded connection indicator arms 50*b*, 50*c* can be accidentally bent downward beyond their limit of elasticity.

When dielectric housing 8 is fully connected with the mating dielectric housing 6, the connection indicator 50 connects with a mating indicator contact 52 (FIG. 6) located inside dielectric housing 6, thus making it possible to ascertain the completeness of the connection. For this purpose, contact members 54 are provided on the upper surface of the spring-loaded connection indicator arms 50*b* and 50*c* to form a connection with indicator contact 52.

Figure 6:
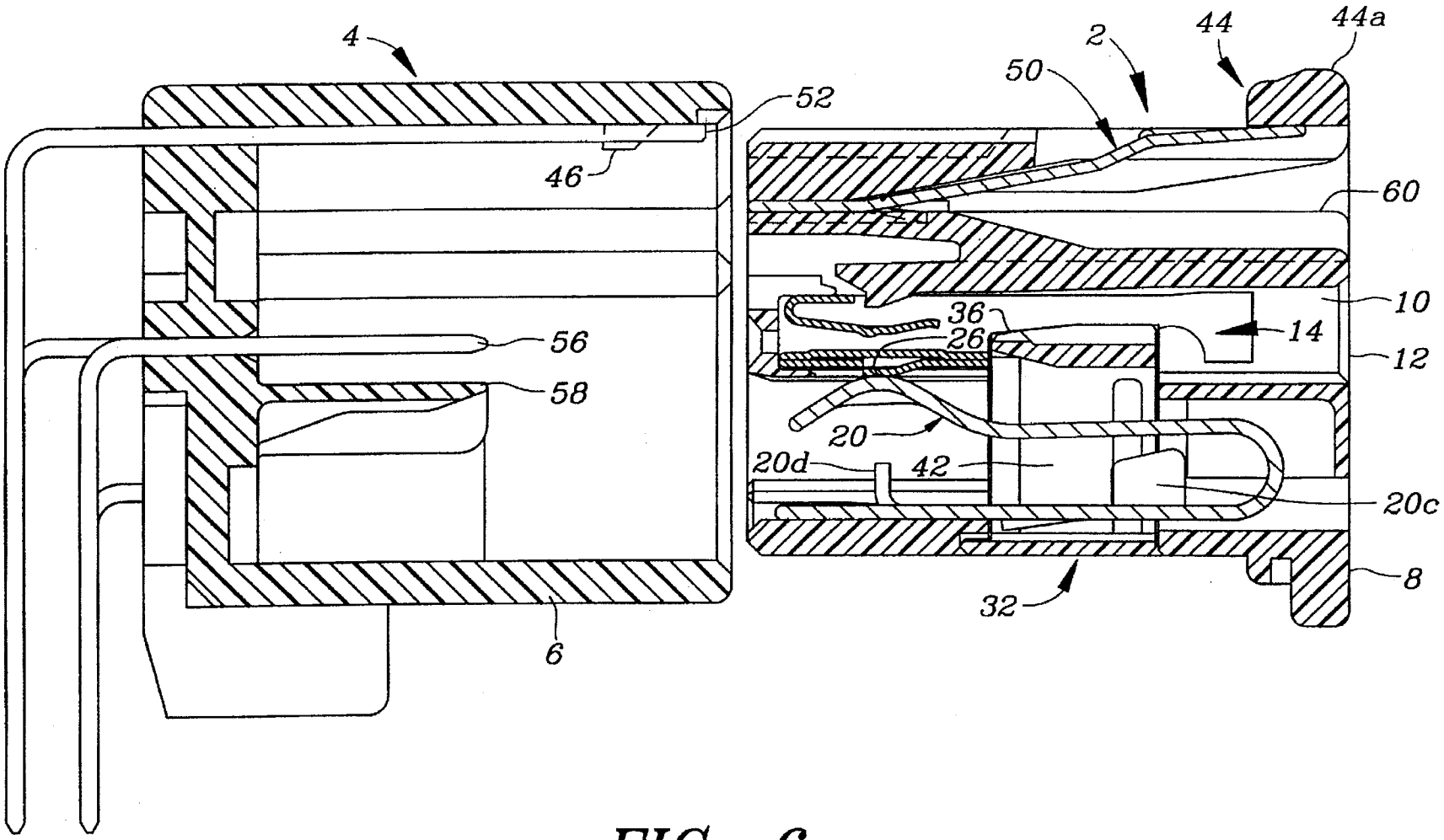
FIG. 6 is a cross-sectional view showing the electrical connector of FIG. 5 before connection with a mating electrical connector.
Figure 7:
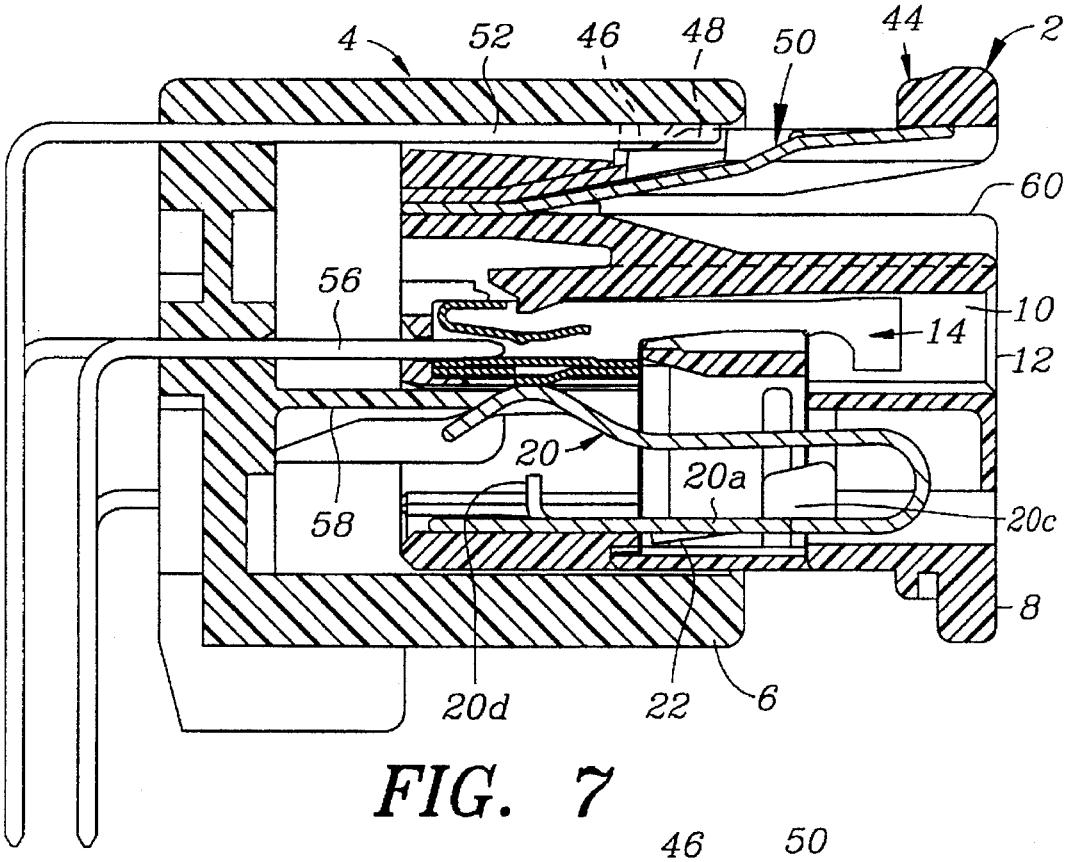
FIG. 7 is cross-sectional view showing the electrical connectors of FIG. 6 in the initial stage of connection.

FIG. 6 shows the mating dielectric housing 6 having pin-shaped male contacts 56 and short-circuit release members 58 arranged generally parallel to male contacts 56. As can be seen from FIGS. 7 through 9, when the two dielectric housings 6 and 8 are joined together, these short-circuit release members 58 slide between the contact arms 20*b* of the short-circuit contacts 20 and the female contacts 14 separating them, thus removing the short-circuited condition. At that time, short-circuit contacts 20 are displaced in a direction away from the female contacts 14 that are being electrically connected with male contacts 56 and this displacement is possible due to the fact that the hollow cavity 42 of the double lock device 32 has the room for such movement.

Figure 8:
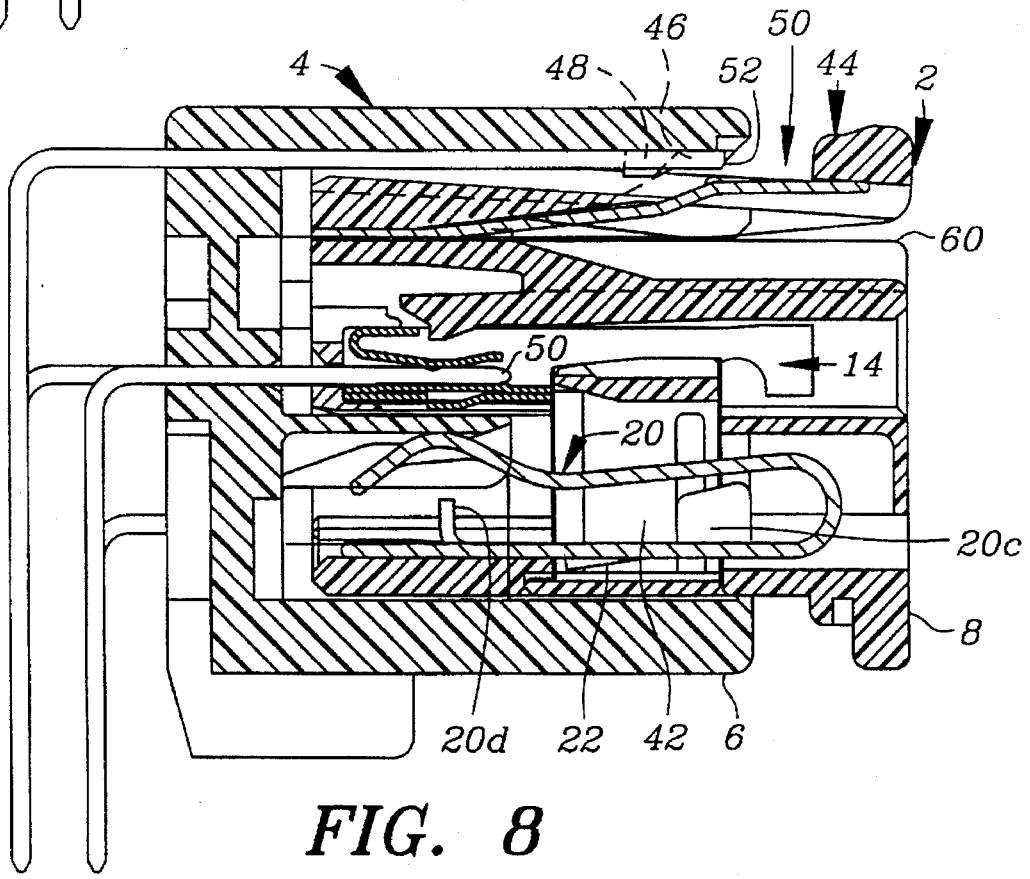
FIG. 8 is a cross-sectional view showing the electrical connectors when they are partly connected.
Figure 9:
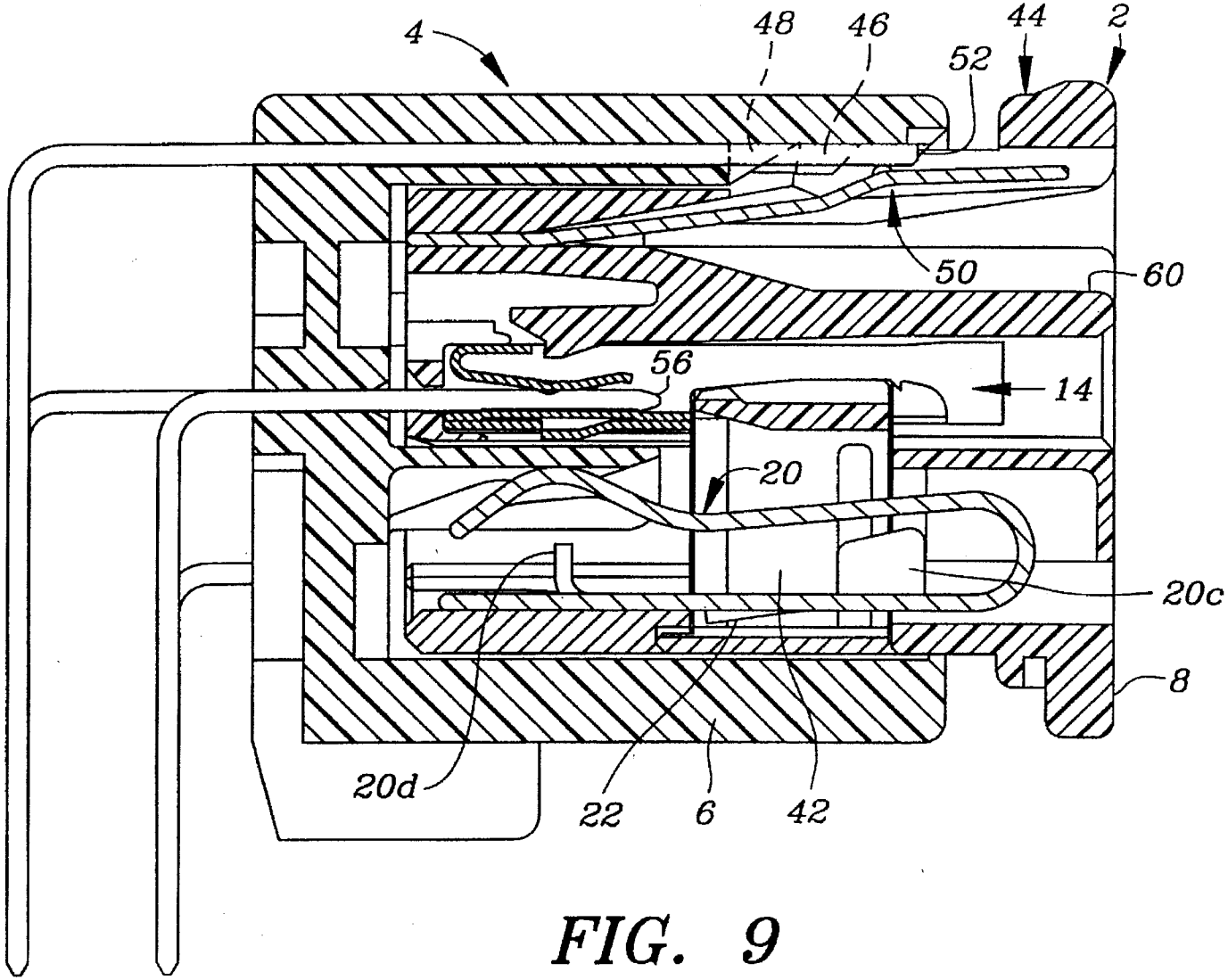
FIG. 9 is a cross-sectional view showing the electrical connectors fully connected.

In addition, the connection indicator 50 and the indicator contacts 52 are not connected together until the latching steps 48 of the latching member 44 and the lugs 46 are engaged (FIG. 8). FIG. 9 shows that connection indicator 50 and indicator contact 52 are electrically connected when the latching steps 48 and lugs 46 become engaged. This makes it possible to determine if dielectric housings 6 and 8 are in a fully connected state.

Above, a description of an embodiment of this invention in an application to the equipment of automotive air bags, however has been set forth, it is obvious that the application of this invention is not limited to only automotive air bag equipment.

I claim:

1. A short-circuit connector comprising:

a dielectric housing having at least two contact cavities located therein and at least one short-circuit cavity located therein adjacent to said contact cavities;

at least two electrical contacts in said contact cavities; and at least one short-circuit contact in said short-circuit cavity including a base, a pair of contact arms extending from said base with free ends extending into said contact cavity making electrical contact with and short-circuiting the electrical contacts, and primary restriction members formed under said pair of short-circuit contact arms for engagement by said contact arms to prevent deformation of said contact arms when said contact arms are moved toward said base.

2. A short-circuit connector of claim 1, wherein said primary restriction members extend lengthwise underneath said contact arms.

3. A short-circuit connector of claim 1, wherein a plurality of contact cavities are located in an upper row and located below said upper row is the short-circuitcavity with at least one opening in a partition located between the contact cavities and the short-circuit cavity for allowing said contact arms to extend into the contact cavities.

4. A short-circuit connector of claim 1, wherein a latch member is located on said base which engages a retainer located in said short-circuit cavity latching said short-circuit contact in the short-circuit cavity.

5. A short-circuit connector of claim 1, wherein resilient latches are located on upper walls of the contact cavities for latching the electrical contacts in the contact cavities.

6. A short-circuit connector of claim 1, wherein a secondary restriction member is provided on said base under said free ends to further prevent deformation of said contact arms when said free ends engage said secondary restriction member.

7. A short-circuit connector of claim 1, wherein an opening is provided in said dielectric housing in which a double lock device is disposed, said double lock device including stop members for engaging said electrical contacts and locking them in place, a hollow cavity for the receipt of part of said short-circuit contact which allows for displacement of said contact arms therein, and lugs that engage the dielectric housing for locking said double lock device in a temporary locked position for the insertion of the electrical contacts in the contact cavities and in a fully locked position for securing the electrical contacts in position in the contact cavities.

8. A short-circuit connector of claim 1, wherein said free ends have an arcuate shape facing upwards to make electrical contact between the short-circuit contact and the electrical contacts.

9. A short-circuit connector of claim 1, wherein a latching member is provided on an upper surface of said dielectric housing for latching said short-circuit connector to a mating connector.

10. A short-circuit connector of claim 9, wherein said latching member has an operating end and latching steps for engaging mating lugs of the mating connector which can be released by pushing the operating end downward.

11. A short-circuit connector of claim 1, wherein a connection indicator is provided on the dielectric housing comprising a base section and spring-loaded connection indicator arms for indicating the connection of the short-circuit connector and a mating connector.

12. A short-circuit connector of claim 11, wherein said spring-loaded connection indicator arms engage a latching member on said dielectric housing to provide spring forces thereto.

13. A short-circuit connector of claim 12, wherein protrusions are located on said dielectric housing under said spring-loaded connection indicator arms to prevent deformation thereof when pressed downward.

14. A short-circuit connector of claim 11, wherein contact members are located on said spring-loaded connection indicator arms to make electrical contact between the connection indicator and a mating connection indicator contact located on the mating connector.

15. A short-circuit connector assembly comprising:

a short-circuit connector including a first dielectric housing having at least two contact cavities located therein and at least one short -circuit cavity located therein adjacent to said contact cavities, at least two electrical contacts in said contact cavities, and at least one short-circuit contact in said short-circuit cavity including a base, a pair of contact arms extending from said base with free ends extending into said contact cavities making electrical contact and short-circuiting the electrical contacts, and primary restriction members formed under said pair of short-circuit contact arms for engagement by said contact arms to prevent deformation of said contact arms when said contact arms are moved toward said base; and a mating connector including a second dielectric housing to connect to said first dielectric housing, at least two mating contacts to connect with said electrical contacts and at least one short-circuit release member to displace said contact arms away from the electrical contacts thereby electrically disconnecting the contact arms from the electrical contacts.

16. A short-circuit connector assembly of claim 15, wherein an opening is provided in said dielectric housing in which a double lock device is disposed, said double lock device including stop members for engaging said electrical contacts and locking them in place, a hollow cavity for the receipt of part of said short-circuit contact which allows for displacement of said contact arms therein, and lugs that engage the dielectric housing for locking said double lock device in a temporary locked position for the insertion of the electrical contacts in the contact cavities and in a fully locked position for securing the electrical contacts in position in the contact cavities.

17. A short-circuit connector assembly of claim 15, wherein a connection indicator is provided on the first dielectric housing and an indicator contact is provided on the second dielectric housing that engages said connection indicator for indicating the short-circuit connector and the mating connector are fully connected.

18. An electrical contact for use in a dielectric housing of an electrical connector and for electrical connection with adjacent electrical contacts in the dielectric housing, the electrical contact being securable in the dielectric housing and comprises a base member;

a pair of contact arms extending upwardly from said base member at an angle thereto and having free ends electrically connectable respectively with the adjacent electrical contacts; and primary restriction members located under said pair of contact arms for engagement by said contact arms to prevent deformation thereof when said contact arms are moved toward said base.

19. An electrical contact as claimed in claim 18, wherein a secondary restriction member is provided on said base member under the free ends to prevent further deformation of said pair of contact arms when said free ends engage said secondary restriction member.

20. An electric contact as claimed in claim 18, wherein said primary restriction members are located on said base member and extend therealong in the same direction as said pair of contact arms.

* * * * *